US011408241B2

(12) United States Patent
Cullum et al.

(10) Patent No.: US 11,408,241 B2
(45) Date of Patent: Aug. 9, 2022

(54) DOWNHOLE PULLING TOOL WITH SELECTIVE ANCHOR ACTUATION

(71) Applicants: Jason Cullum, League City, TX (US); Knut Inge Dahlberg, Tomball, TX (US); Waqas Munir, Houston, TX (US); Mohsen Ali, Bellaire, TX (US); Dan Wells, Houston, TX (US); Andrew Ponder, Houston, TX (US); Per Daykin, Soreidgrend (NO); Eivind Hagen, Kvernaland (NO)

(72) Inventors: Jason Cullum, League City, TX (US); Knut Inge Dahlberg, Tomball, TX (US); Waqas Munir, Houston, TX (US); Mohsen Ali, Bellaire, TX (US); Dan Wells, Houston, TX (US); Andrew Ponder, Houston, TX (US); Per Daykin, Soreidgrend (NO); Eivind Hagen, Kvernaland (NO)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/944,741

(22) Filed: Jul. 31, 2020

(65) Prior Publication Data

US 2022/0034182 A1 Feb. 3, 2022

(51) Int. Cl.
*E21B 31/16* (2006.01)
*E21B 29/00* (2006.01)
(Continued)

(52) U.S. Cl.
CPC ..... *E21B 31/16* (2013.01); *E21B 23/01* (2013.01); *E21B 29/005* (2013.01); *E21B 31/20* (2013.01)

(58) Field of Classification Search
CPC ..... E21B 23/01; E21B 23/04; E21B 23/0411; E21B 29/005; E21B 31/16
See application file for complete search history.

(56) References Cited

U.S. PATENT DOCUMENTS 2,481,637 A * 9/1949 Yancey ..... E21B 31/16 166/55.1
5,318,115 A * 6/1994 Rouse ..... E21B 4/02 166/361
(Continued)

FOREIGN PATENT DOCUMENTS

EP 0504848 A1 9/1992
GB 2562088 A * 11/2018 ..... E21B 29/00
(Continued)

OTHER PUBLICATIONS

Ardyne, "Resetting The Standard For Openhole Casing Recovery", 2 pages, Jan. 2018 (Year: 2018).*
(Continued)

*Primary Examiner* — Jennifer H Gay
(74) *Attorney, Agent, or Firm* — Cantor Colburn LLP

(57) ABSTRACT

A single-trip cut and pull system for a wellbore including a cutter, a power section, and an anchor selectively actuable independently of the power section; a method for cutting and pulling casing in a single run including running a cut and pull system on a string to a target depth, rotating a cutter of the cut and pull system to cut a casing section, and actuating an anchor of the cut and pull system after cutting the casing section; and a method for cutting and pulling casing in a single run including running a cut and pull system on a string to a target depth, rotating a cutter of the cut and pull system by rotating the string to cut a casing section, and pulling the cut casing in the single run.

22 Claims, 14 Drawing Sheets

(51) Int. Cl.
*E21B 23/01* (2006.01)
*E21B 31/20* (2006.01)

(56) References Cited

U.S. PATENT DOCUMENTS

| | | | | |
|---|---|---|---|---|
| 6,357,528 | B1 * | 3/2002 | Davis | E21B 29/005 166/339 |
| 7,762,330 | B2 * | 7/2010 | Saylor, III | E21B 31/16 166/298 |
| 8,869,896 | B2 | 10/2014 | Crow et al. | |
| 10,024,127 | B2 * | 7/2018 | Plante | E21B 34/12 |
| 10,041,322 | B2 * | 8/2018 | Braddick | E21B 29/005 |
| 10,113,394 | B2 * | 10/2018 | Hekelaar | E21B 31/107 |
| 10,309,179 | B2 * | 6/2019 | Glaser | E21B 23/04 |
| 10,392,901 | B2 | 8/2019 | Eversten | |
| 10,724,328 | B2 * | 7/2020 | Kruger | E21B 33/13 |
| 10,781,653 | B2 * | 9/2020 | Sunde | E21B 29/005 |
| 10,954,736 | B2 * | 3/2021 | Schmidt | E21B 31/20 |
| 2002/0162659 | A1 * | 11/2002 | Davis | E21B 29/005 166/298 |
| 2008/0236829 | A1 * | 10/2008 | Lynde | E21B 31/16 166/298 |
| 2009/0050310 | A1 * | 2/2009 | McKay | E21B 31/16 166/55.7 |
| 2010/0006290 | A1 * | 1/2010 | Saylor, III | E21B 31/16 166/298 |
| 2014/0096947 | A1 * | 4/2014 | Colbert | E21B 31/16 166/55.2 |
| 2015/0129195 | A1 * | 5/2015 | Laird | E21B 31/16 166/55.8 |
| 2015/0226031 | A1 * | 8/2015 | Hekelaar | E21B 21/103 166/298 |
| 2016/0076327 | A1 * | 3/2016 | Glaser | E21B 31/20 166/301 |
| 2016/0130901 | A1 * | 5/2016 | Coronado | E21B 29/002 166/298 |
| 2016/0265295 | A1 * | 9/2016 | Plante | E21B 31/20 |
| 2016/0273307 | A1 | 9/2016 | Evertsen et al. | |
| 2017/0122053 | A1 * | 5/2017 | Braddick | E21B 29/00 |
| 2018/0100373 | A1 * | 4/2018 | Kruger | E21B 29/002 |
| 2018/0202250 | A1 * | 7/2018 | Braddick | E21B 23/00 |
| 2019/0162046 | A1 * | 5/2019 | Engevik | E21B 29/005 |
| 2019/0257168 | A1 * | 8/2019 | Sunde | E21B 29/00 |
| 2020/0224509 | A1 * | 7/2020 | Telfer | E21B 23/01 |
| 2020/0232295 | A1 * | 7/2020 | Telfer | E21B 10/322 |
| 2020/0347687 | A1 * | 11/2020 | Sunde | E21B 31/16 |
| 2021/0032948 | A1 * | 2/2021 | Stewart | E21B 31/16 |

FOREIGN PATENT DOCUMENTS

| | | | | |
|---|---|---|---|---|
| GB | 2568914 | A * | 6/2019 | E21B 31/16 |
| GB | 2574647 | A * | 12/2019 | E21B 47/09 |
| NO | 344192 | B1 | 7/2019 | |
| WO | WO-2017182549 | A1 * | 10/2017 | E21B 31/20 |
| WO | WO-2018083473 | A1 * | 5/2018 | E21B 23/01 |
| WO | WO-2019239100 | A1 * | 12/2019 | E21B 47/09 |
| WO | WO-2020025948 | A1 * | 2/2020 | E21B 33/13 |
| WO | WO-2020035678 | A1 * | 2/2020 | E21B 29/002 |
| WO | 2020095043 | A1 | 5/2020 | |
| WO | WO-2020161227 | A1 * | 8/2020 | E21B 23/006 |
| WO | WO-2020165367 | A1 * | 8/2020 | E21B 31/005 |

OTHER PUBLICATIONS

Ardyne, "Cost Effective Openhole Casing Recovery", 2 pages, Oct. 2017 (Year: 2017).*

James Linklater, Ardyne, "Wells Abandonment Accelerated, Decelopment of a Single-Trip, Casing-On-Deck System", 18 pages, 2018 (Year: 2018).*

Ardyne, "33 Hours of Rig Time Saved", 2016, 2 pages (Year: 2016).*

Notification of Transmittal of the International Search Report and the Written Opinion of the International Searching Authority, or the Declaration; PCT/US2021/043706; dated Nov. 4, 2021; 10 pages.

* cited by examiner

DOWNHOLE PULLING TOOL WITH SELECTIVE ANCHOR ACTUATION

BACKGROUND

In the resource recovery industry there are many operations that have a well known sequence in order to be effective. For tools involving anchoring to the borehole wall or a casing or tubing therein, the anchor is generally engaged first since the purpose of the anchor is to allow relative movement of another tool that uses the anchor to bear against during operation. Because of this historic paradigm, tools with anchors such as pulling tools (also known as Jack tools) including casing cutting and pulling tools all operate with an anchor setting in the first instance and build functionality from that point. While tools in this paradigm are useful and productive, they are also limited in some functionalities that might otherwise be available. Since the art is always interested in alternatives and improvements, the disclosure hereof will be well received by the industry.

SUMMARY

An embodiment of a single-trip cut and pull system for a wellbore including a cutter, a power section, and an anchor selectively actuable independently of the power section.

A method for cutting and pulling casing in a single run including running a cut and pull system on a string to a target depth, rotating a cutter of the cut and pull system to cut a casing section, and actuating an anchor of the cut and pull system after cutting the casing section.

An embodiment of a borehole system including a borehole in a subsurface formation, a string in the borehole, a single-trip cut and pull system disposed as a part of the string, the a single-trip cut and pull system as in any prior embodiment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
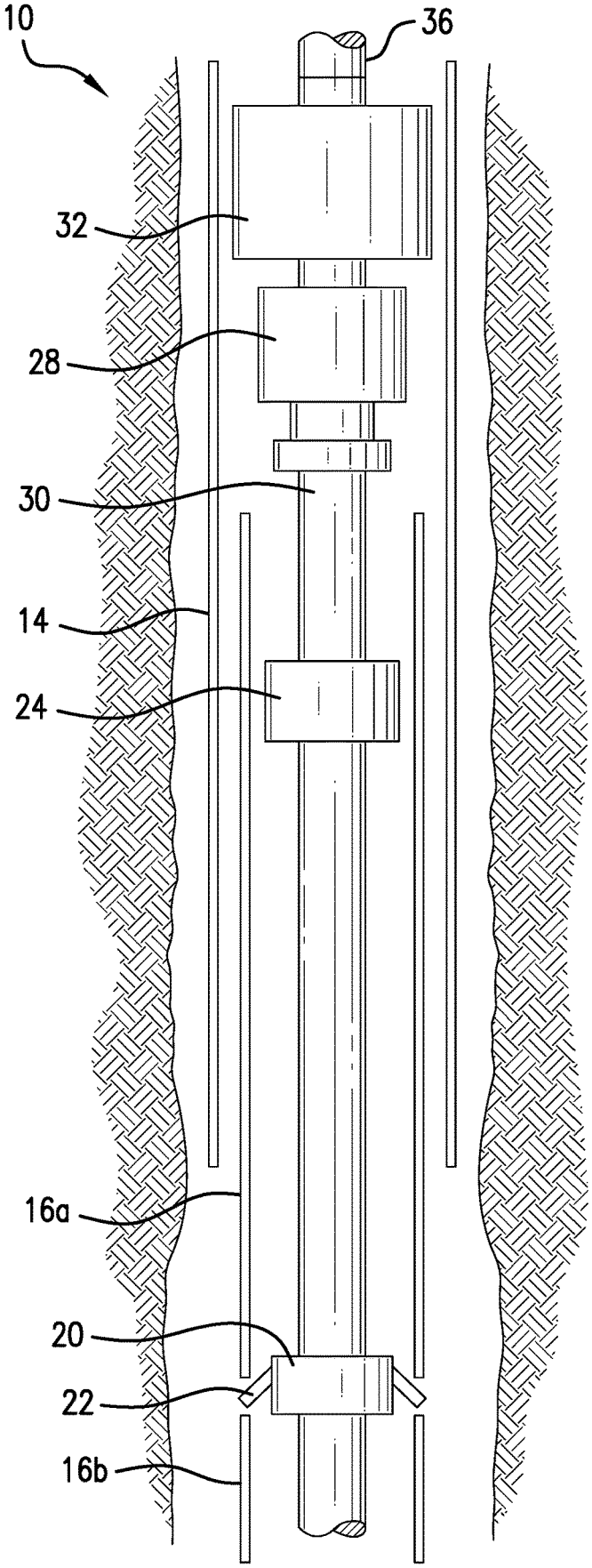
FIG. 1 is a schematic illustration of a single trip cut and pull system disclosed herein in a cutting position.
Figure 2:
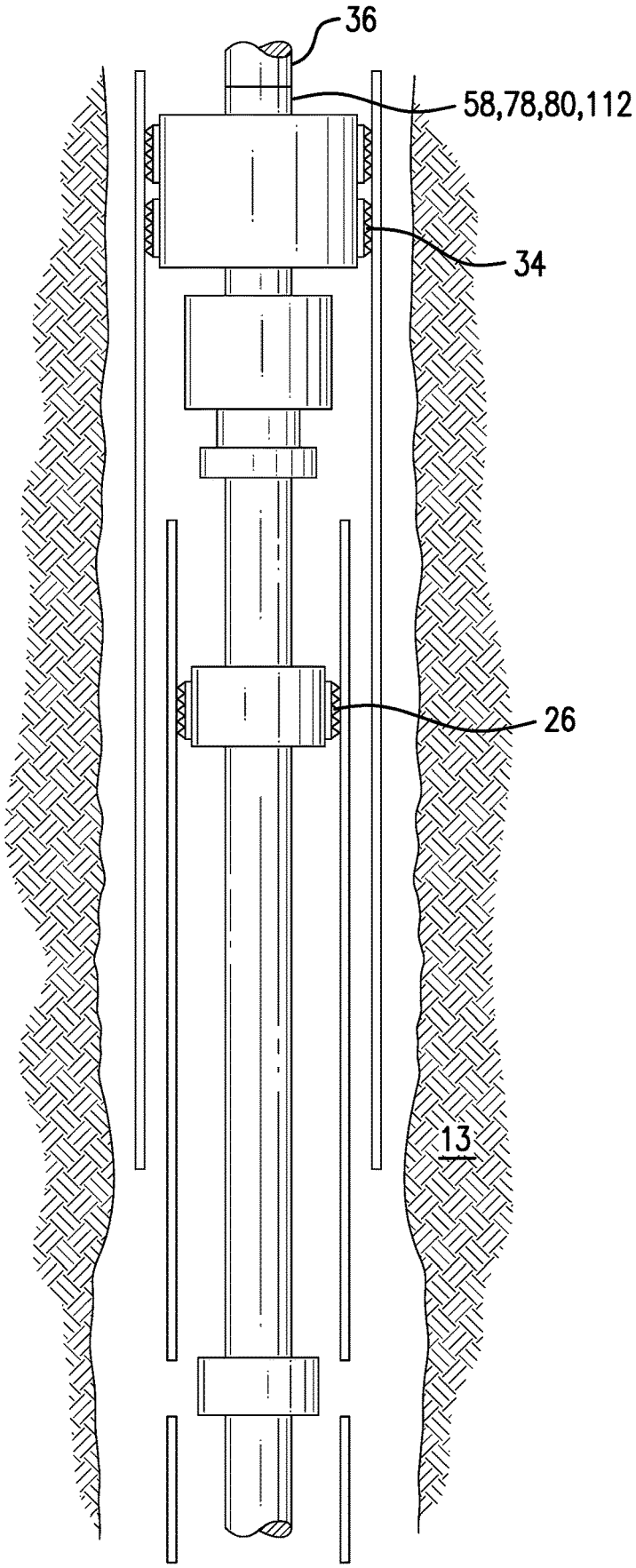
FIG. 2 is the view of FIG. 1 in a pulling position.

Referring to FIGS. 1 and 2, a cut and pull system 10 as disclosed herein is illustrated schematically in a borehole 12 in a subsurface formation 13 having a first casing 14 and second casing 16 therein. The system 10 is disposed within the borehole 12 and the first and second casings 14 and 16 respectively to be able to cut through a section of the second casing 16, creating sections 16*a* and 16*b* so that section 16*a* can be removed from the borehole 12.

The system 10 includes a cutter 20 having a blade 22, a spear 24 having engagement pads 26, a power section 28 capable of stroking a stroke mandrel 30 and an anchor 32 having slips 34. All of these are a part of a string 36 during use in a borehole 12.

The cutter 20 is operated by rotation of the string 36 from surface. This avoids the need for a separate motor in the system 10 thereby reducing cost and complexity over prior art cut and pull systems. The spear 24 is a left hand turn to set device that can be rotated for extended periods in the unset position and then set with a ¼ or ½ left hand turn of the string 36. The power section 28 and anchor 32 are actuable independently of anything else in the system 10. This is important to the present disclosure because the independent actuation of the anchor 32 allows for the cutter 20 to be actuated by rotation of the string as opposed to a motor disposed downhole of the anchor 32. The independent actuation of the anchor 32 is achieved through a number of embodiments (the anchor embodiments being referred to as 32*a*-32*d* to differentiate variations) discussed below but in each case a switch 40 is employed to selectively enable or disable the anchor responding to an input.

Figure 3:
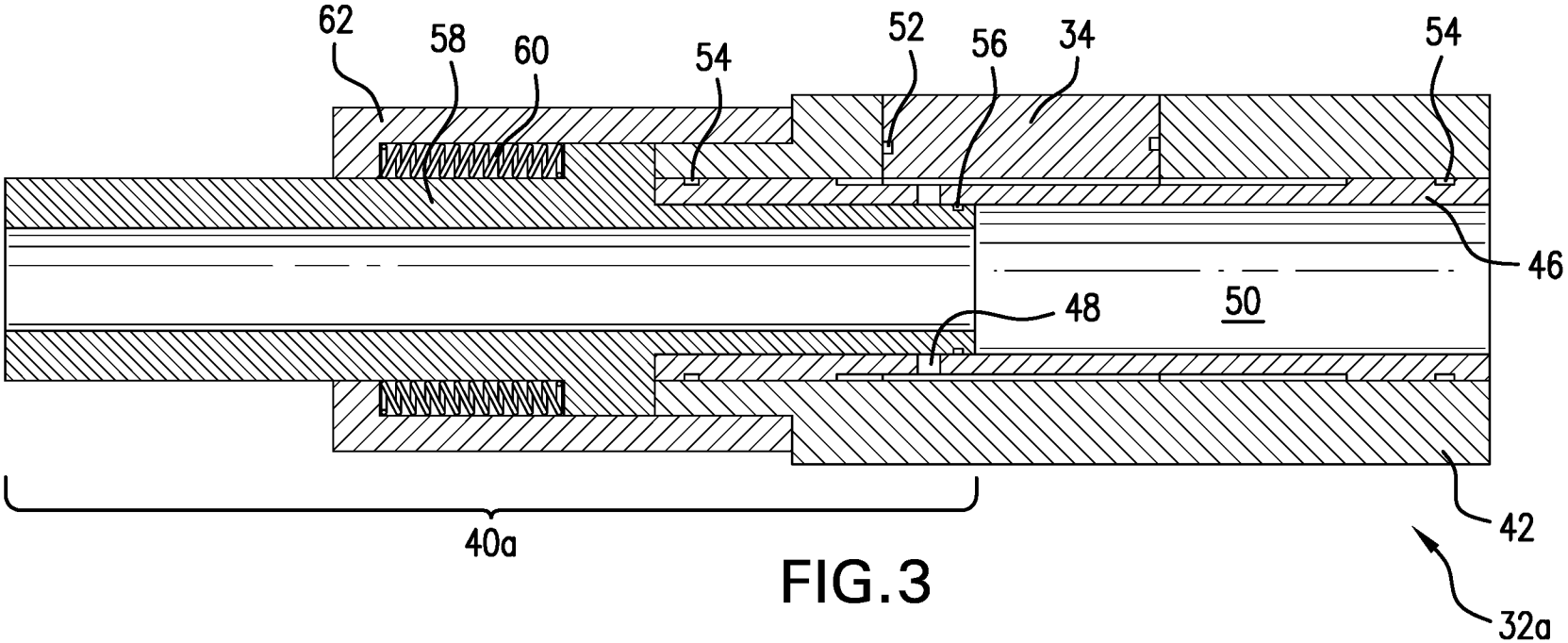
FIG. 3 is a cross sectional view of an embodiment of the anchor of the cut and pull system illustrated in FIGS. 1 and 2 in a resting position.
Figure 4:
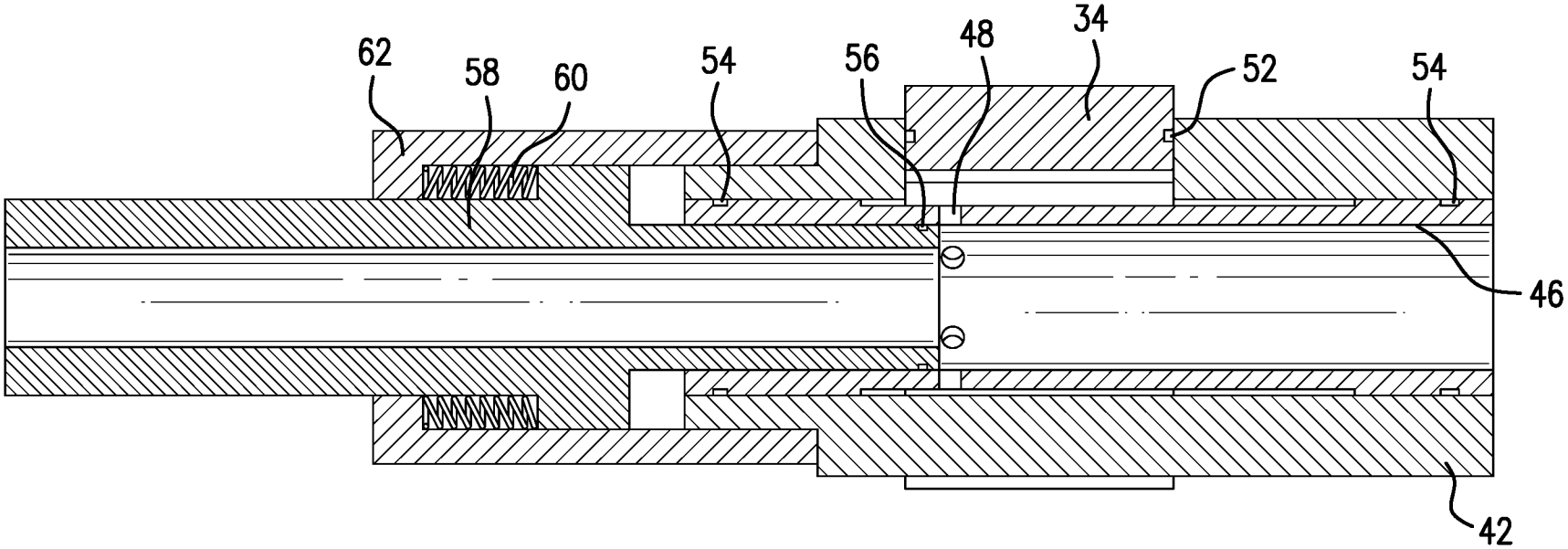
FIG. 4 is the embodiment of FIG. 3 in a responsive position.

In an embodiment, referring to FIGS. 3 and 4, a hydraulic input is available in the form of fluid pressure in the string 36. The switch 40 is a tension valve disposed as a part of the anchor 32*a*. The anchor 32*a* in this embodiment comprises a housing 42 with one or more slips 34 disposed slideably therein. A pressure sleeve 46 is disposed within the housing 42. The pressure sleeve 46 includes a port 48 that is fluidly connected to the slip 34. The port 48 may be cycled (repeatedly) between annulus pressure and tubing pressure from inside diameter area 50 due to seal 52 on slip 34, seals 54 on pressure sleeve 46 (one on either side of the port 48), and a seal 56 on a mandrel 58 movably disposed within the pressure sleeve 46. Cyclability of the mandrel is due to a biasing member 60 and the ability to compress the biasing member 60 through tension on the mandrel 58 against the set spear 26 discussed above. The biasing member 60, which may be a spring member such as a stack of cone washers, a coil spring, an elastomer, etc. returns the mandrel 58 to a position covering the port 48 when tension along the mandrel 58 is relieved. The mandrel 58 and biasing member 60 are retained to the housing 42 by a retainer 62.

When tubing pressure is provided to the port 48 (by applying a tensile load on the mandrel 58 against the spear 26, the slip 34 will move radially outwardly due to a pressure differential (tubing to annulus) across seals 52. This condition can be seen in FIG. 4. In this condition, the anchor 32*a* is set in the casing 14 and cannot move. When the ports 48 are not exposed to tubing pressure however, which is the condition illustrated in FIG. 3, then the port is exposed to annulus pressure and the slip is easily pushed back into the housing 42 by bumping into the casing 14. That these things occur is due to the seals 54 on pressure sleeve 46 that are located at opposite sides of the port 48 and due to the seal 56 on a mandrel 58. It will be appreciated that the mandrel 58 is not sealed to surrounding components other than at seal 56. Accordingly, if the seal 56 is downhole of the port 48, also meaning the mandrel 58 covers the port 48, then tubing pressure is isolated from the port 48 but annulus pressure extending around the unsealed balance of mandrel 58 does have access to the port 48. The slip 34 then is balanced with annulus pressure on both sides of the seal 52. Alternatively, when the mandrel is in the position shown in FIG. 4, the seal 56 is between the port 48 and the annulus pressure such that port 48 is exposed only to tubing pressure. When tubing pressure is higher than annulus pressure, the slip 34 will move radially outwardly to engage with the casing 14 to anchor the system 10 to the casing 14.

The configuration of anchor 32*a* is insensitive to tubing pressure prior to the switch 40 being activated. Accordingly, pressure may be applied to operate other tools or trigger other operations without causing the anchor 32*a* to set. As such, the string is still rotationally free and can be used to rotate the cutter 20 to cut casing 16. After the cutting is complete, the spear 26 is set by left hand turn of string 36 and then tension is applied to mandrel 58 through string 36 setting the anchor. Simultaneously with the anchor 32 being set, the power section 28 strokes the stroke mandrel 30 and begins pulling the section 16*a*. The anchor 32 may be released and reset (generally in a more uphole location) by reduction of tubing pressure to unset the slips 34, movement of the anchor uphole, application of tension to the mandrel 58 through string 36, and reapplication of tubing pressure to reset the slips 34. This action may be performed multiple times until the casing section 16*a* will move under the impetus of the derrick only.

Figure 5:
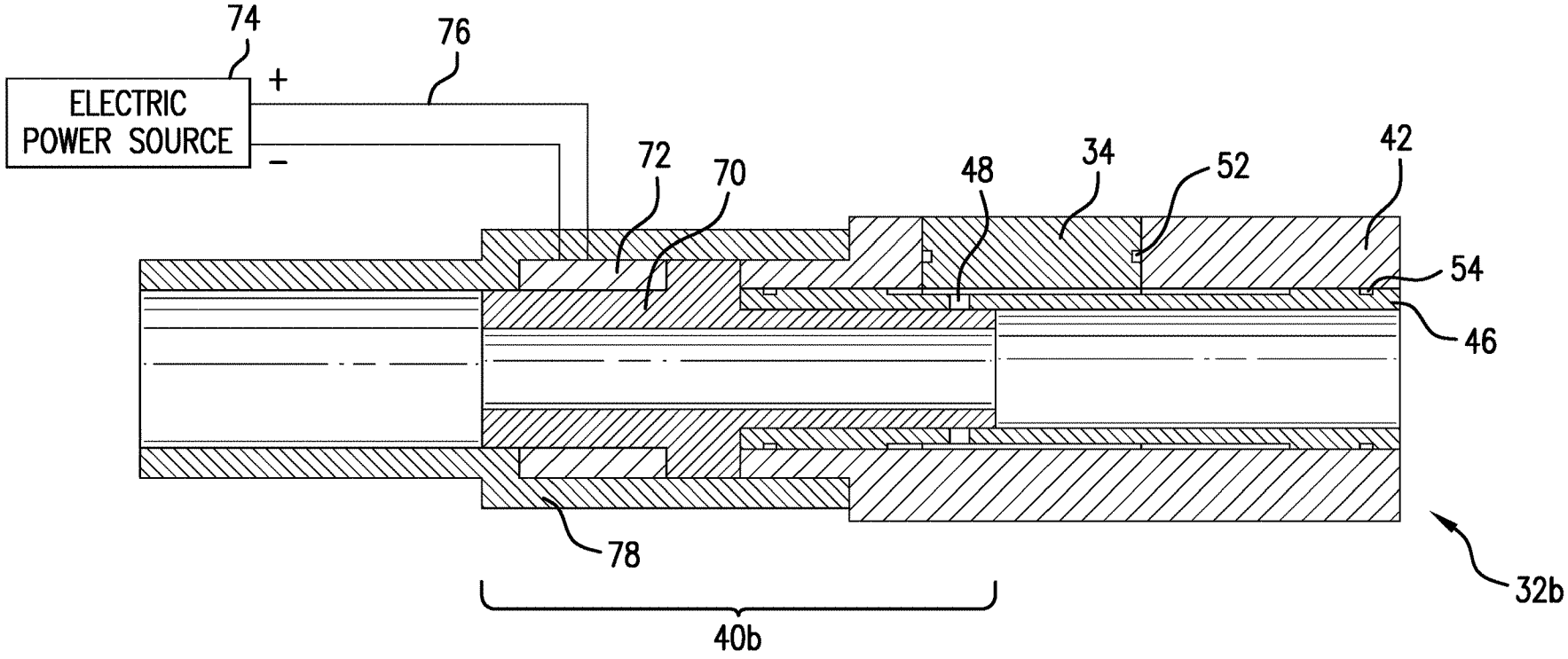
FIG. 5 is a cross sectional view of another alternate embodiment of the anchor of the cut and pull system illustrated in FIGS. 1 and 2 in a resting position.
Figure 6:
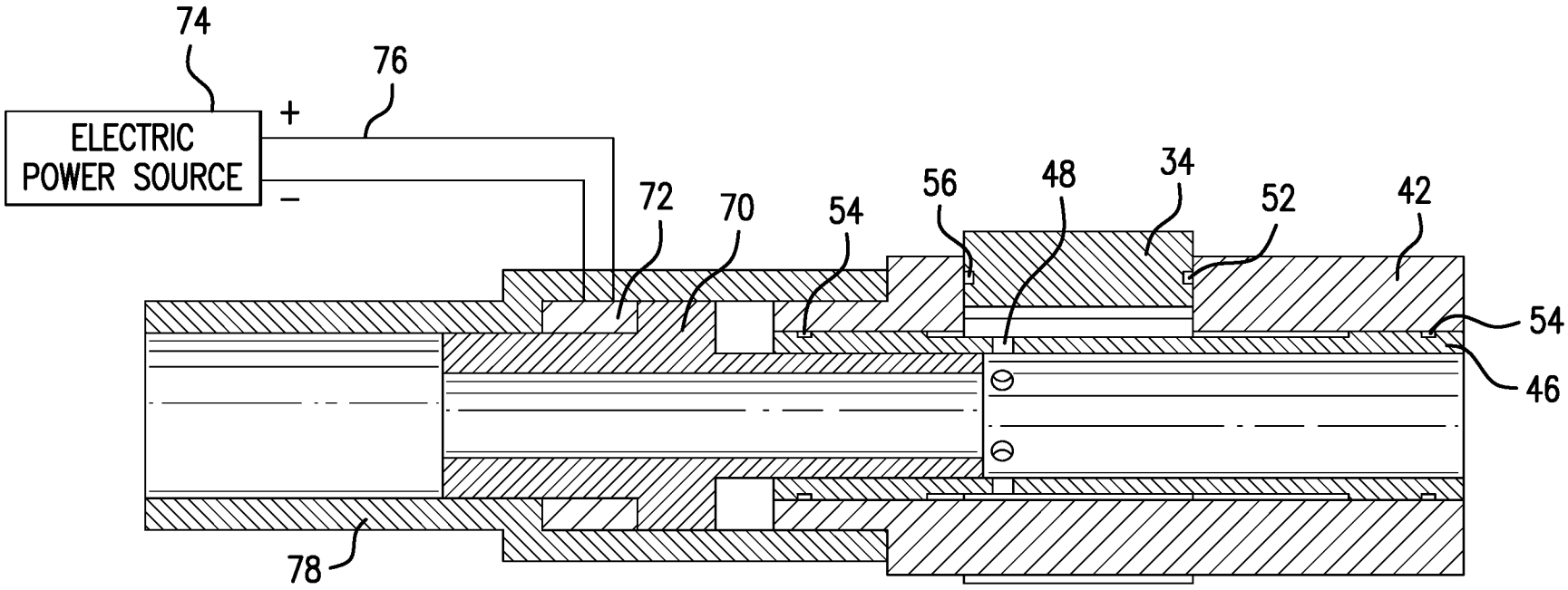
FIG. 6 is the embodiment of FIG. 5 in a responsive position.

In an alternate embodiment, referring to FIGS. 5 and 6, The same ultimate function is achieved with a differing switch mechanism 40*b*. It should first be noted that the housing 42, pressure sleeve 46, slip 34, port 48 seals 54, seal 52 and seal 56 are all identical to FIGS. 3 and 4. Function of these components is also identical. In this embodiment, mandrel 58 has been replaced by mandrel 70, which is not in the tensile path of the string 36. The movement of mandrel 70 is no longer dependent upon tensile load through string 36 but rather is created by an electromechanical device 72 that in one construction takes the place of biasing member 60 in the embodiment of anchor 32*a*. The electromechanical device is connected to a power source 74 through appropriate connections 76, that source being local or remote as desired. Upon application of an appropriate electrical signal, the device 72 causes the movement of the mandrel 70. In one variation, the mandrel 70 and device 72 constitute a solenoid. Other variations include a motor and planetary gear, a linear actuator, gear and worm drive with an electric motor, etc. It should also be noted that the retainer 62 in FIGS. 3 and 4 has also been substituted and now is configured as retainer 78 that connects to string 36. Substituting the solenoid arrangement of mandrel 70 and device 72 to impart the movement of the mandrel with regard to the port 48, the anchor 32*b* otherwise functions identically to that of anchor 32*a*.

Figure 7A:
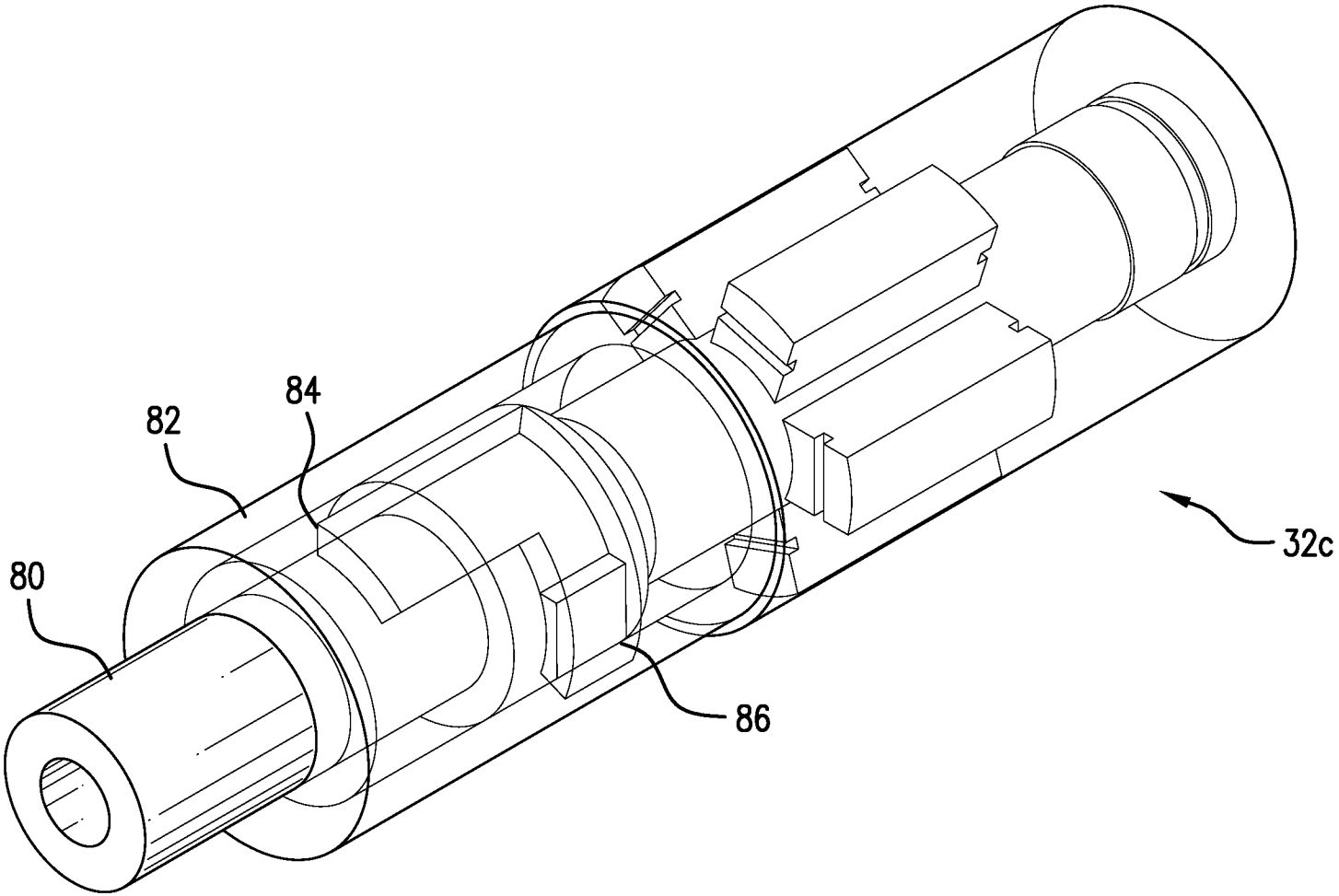
FIG. 7*a* is an isometric view of another embodiment of the anchor of the cut and pull system illustrated in FIGS. 1 and 2 in a resting position.
Figure 7B:
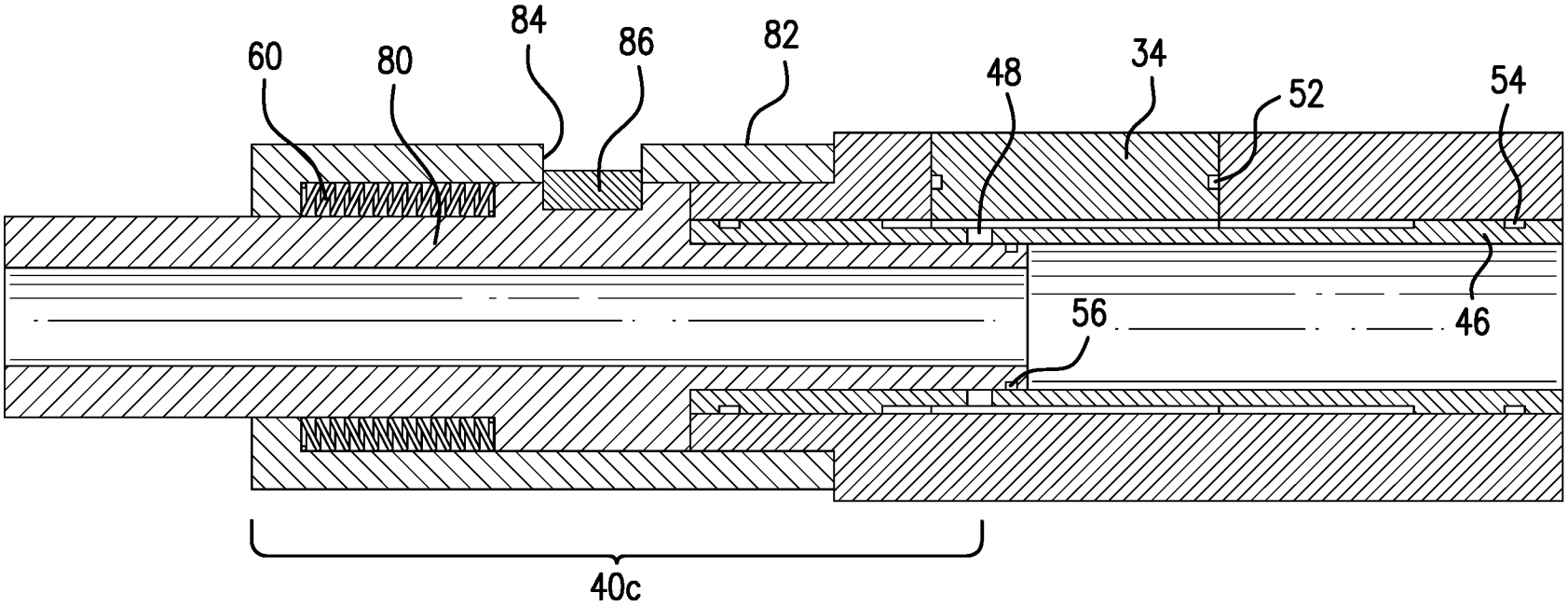
FIG. 7*b* is a cross section view of FIG. 7*a;*
Figure 8A:
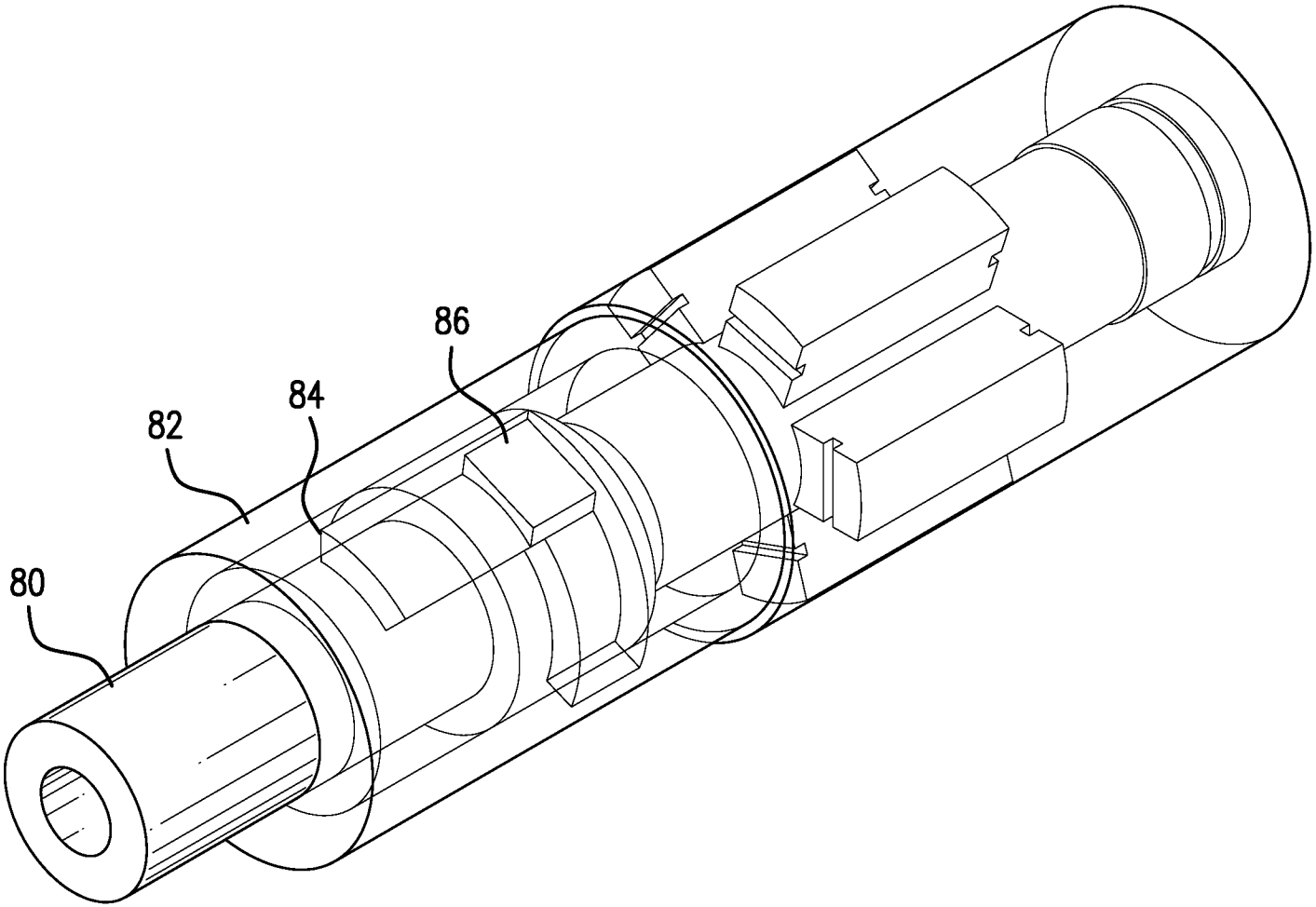
FIG. 8*a* is the embodiment of FIG. 9*a* in an aligned position.
Figure 8B:
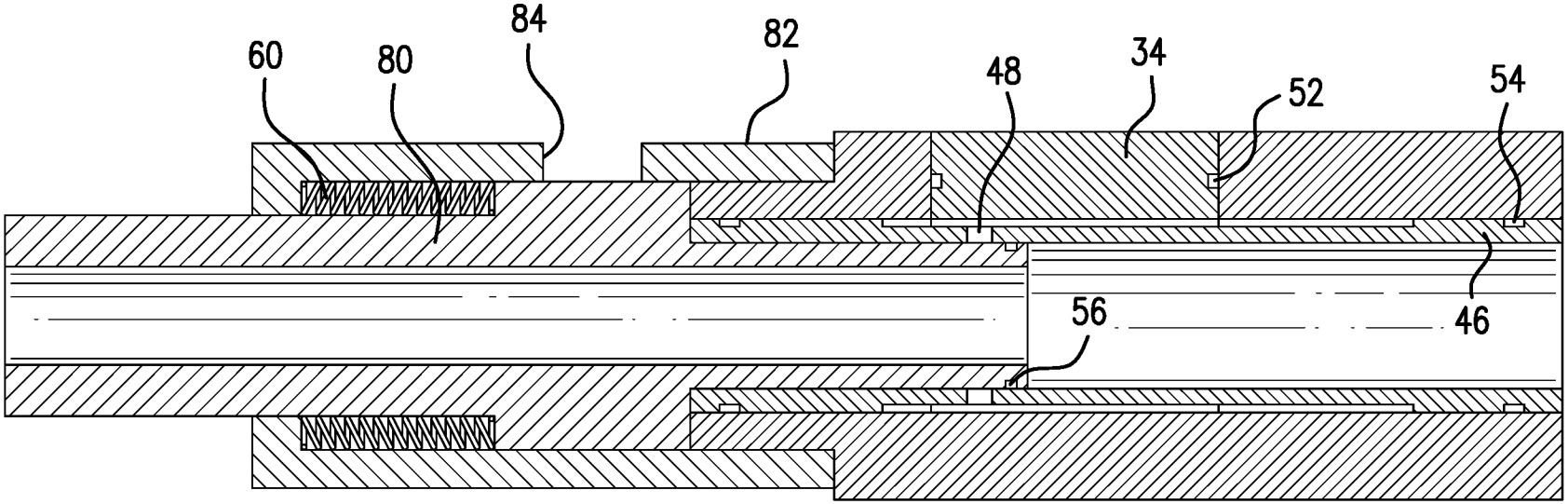
FIG. 8*b* is a cross section view of FIG. 8*a;*
Figure 9A:
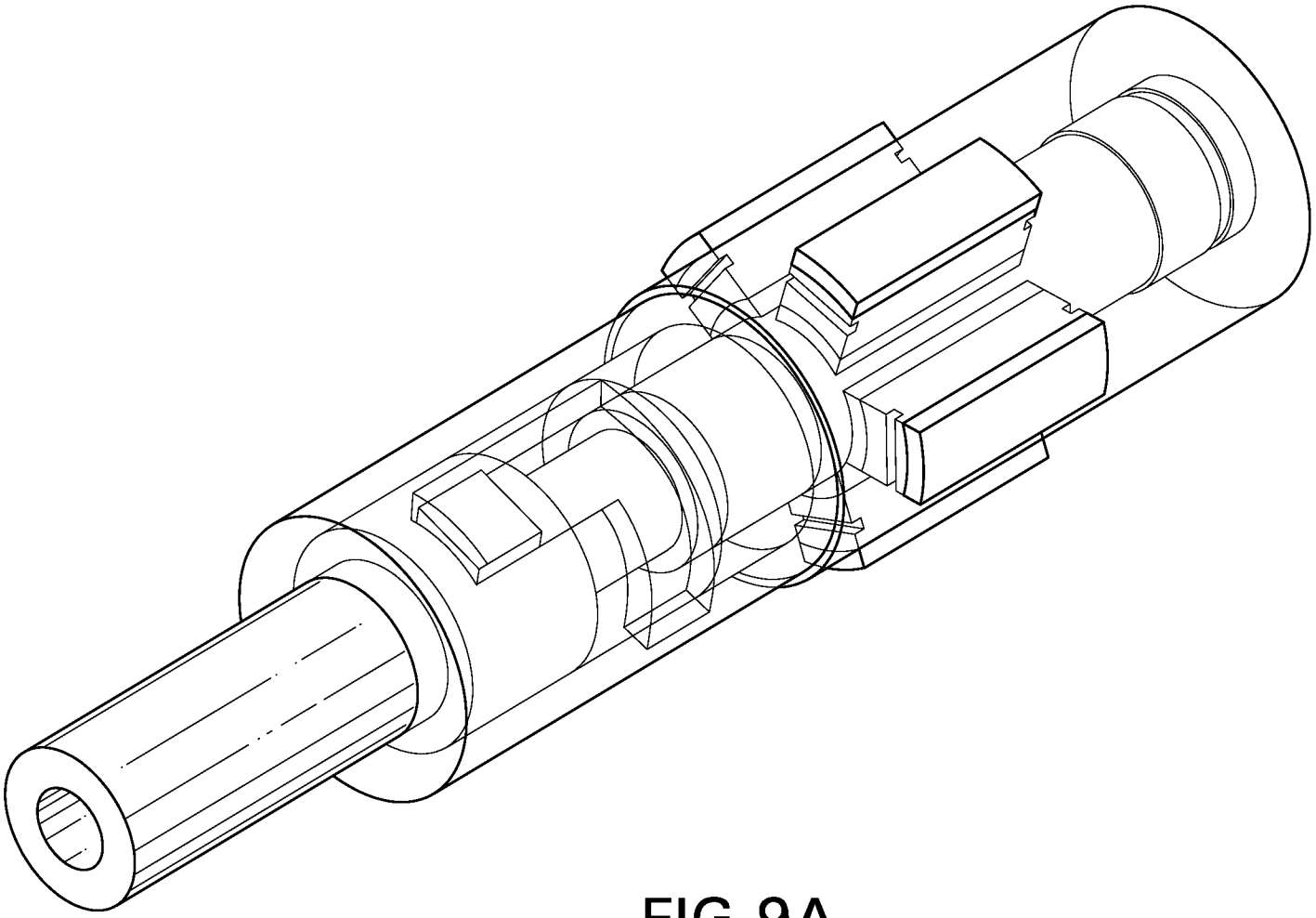
FIG. 9*a* is the embodiment of FIG. 7*a* in a responsive position to tensile load.
Figure 9B:
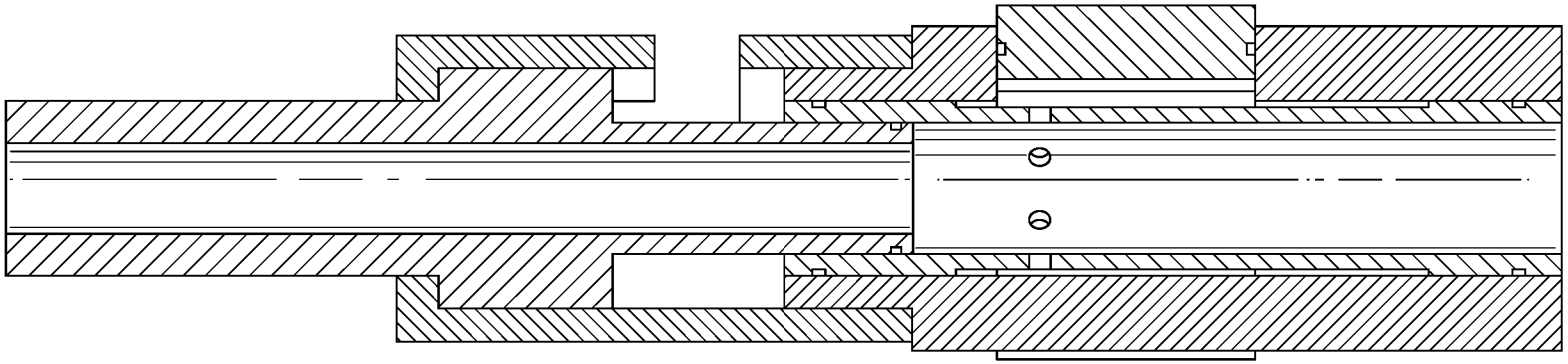
FIG. 9*b* is a cross section view of FIG. 9*a;*

Referring to FIGS. 7*a* through 9*b* another alternate embodiment of the anchor 32*c* is illustrated in cross section having a differing switch mechanism 40*c* that operates by rotation of the mandrel therein prior to tension being effective. This embodiment is similar to the foregoing embodiments using a number of the same components. Specifically, the housing 42, pressure sleeve 46, slip 34, port 48 seals 54, seal 52, seal 56 and optionally biasing member 60 are all identical to FIGS. 3 and 4. Function of these components is also identical. In this embodiment, mandrel 58 from FIGS. 3 and 4 has been replaced by mandrel 80 that interacts with retainer 82 through a J-slot type configuration. Slot 84 is disposed in retainer 82 and lug 86 is fixedly attached or a part of mandrel 80. The view of FIG. 7*a* is one that does not permit tensile activation of the valve because the tensile load applied to the mandrel 80 is borne through the lug 86 and retainer 82 to the housing 42. The anchor in this position is thus insensitive to tensile load thereon with respect to actuation. Moving to FIGS. 8*a* and 8*b*, the anchor 32*c* has been repositioned such that the lug 86 is illustrated in a part of the slot 84 that allows longitudinal movement of the mandrel 80 relative to the retainer 82. FIGS. 9*a* and 9*b* illustrate the result of tensile load applied to the anchor 32*c* in the position illustrated in 8*a* and 8*b*. In the position of 9*a* and 9*b*, the port 48 is open and the anchor 32*c* is set.

Figure 10:
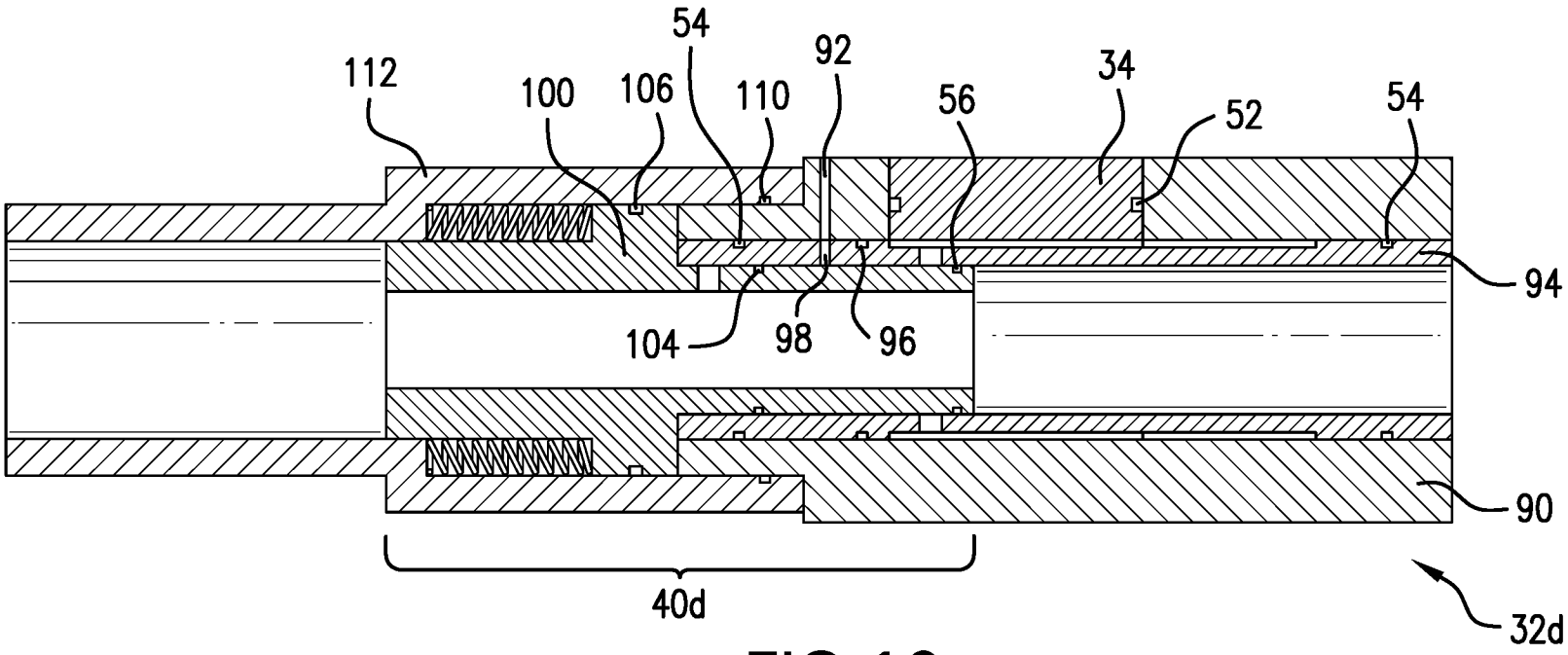
FIG. 10 is a cross sectional view of another alternate embodiment of the anchor of the cut and pull system illustrated in FIGS. 1 and 2 in a resting position.
Figure 11:
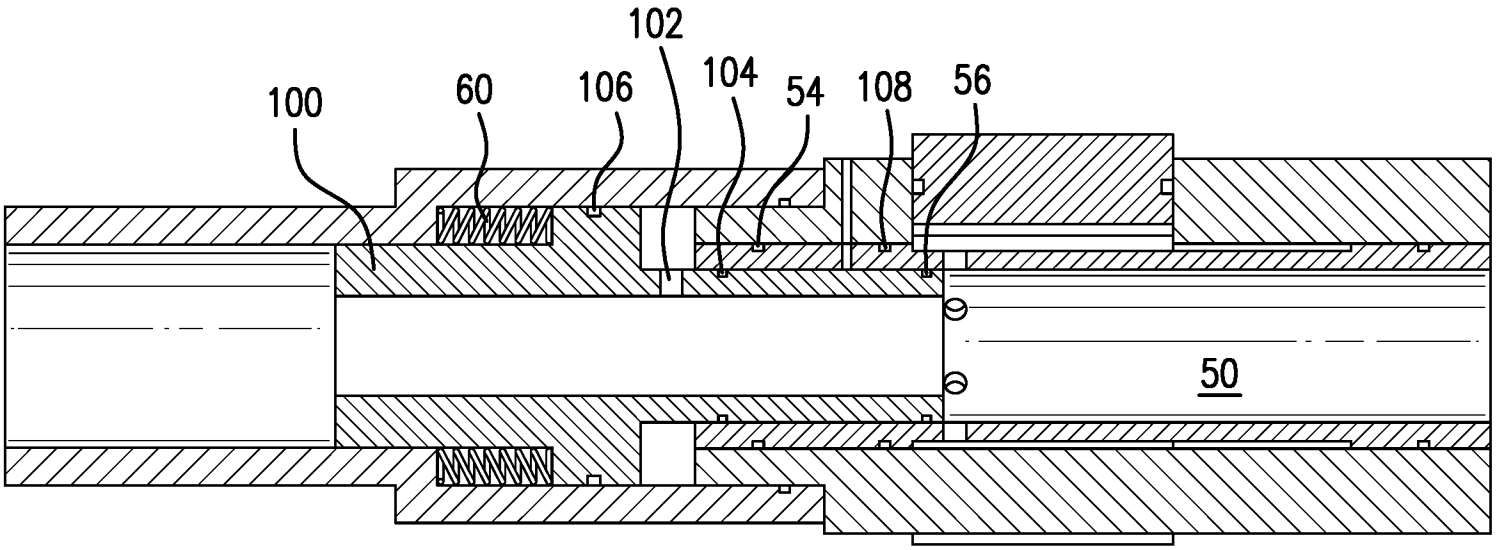
FIG. 11 is the embodiment of FIG. 10 in a responsive position.

Referring to FIGS. 10 and 11, yet another embodiment is illustrated. This embodiment of the anchor 32, denoted anchor 32*d*, is a hydraulic embodiment wherein the hydraulic setting is only achievable after a threshold hydraulic pressure is reached to activate the switch 40*d*. Components that are identical to components discussed in other embodiments above are slip 34, seal 52, seal 56, biasing member 60 and port 48 are identical while the housing, pressure sleeve, mandrel, and retainer are modified. Modifications for this embodiment all relate to pressure pathways and seals placed in/on the various modified components. Housing 90 includes an annulus pathway 92 to ensure in an unactuated position, the slip 34 will see annulus pressure on both sides of the seal 52. Pathway 92 is a part of an unsealed pressure pathway to port 48. Otherwise the housing 90 is the same as the housing 42. The pressure sleeve 94 includes an additional seal 96 and an additional orifice 98. Seal 96 prevents the tubing pressure from leaking straight to pathway 92 when the switch 40*d* is in the activated open position. The activated position of switch 40*d* provides access of tubing pressure from area 50 to port 48 and thence to slip 34. The setting action happens exactly as above. To get the switch 40*d* to this position however, hydraulic pressure from area 50 is used to stroke a mandrel 100 by pressurizing through an opening 102. An additional seal 104 is placed upon mandrel 100 to prevent tubing pressure leaking to annulus through opening 102 and a third seal 106 is placed uphole of the opening 102 for the same reason. Further additional seals not in prior embodiments are seal 108 on pressure sleeve 94 and seal 110 on retainer 112. A threshold pressure in the string 36 including at area 50 will cause this embodiment to move from the position of FIG. 10 toward the position of FIG. 11 and continued pressure above that threshold will supply pressure to set the slip 34. When pressure is reduced below the threshold pressure, the mandrel 100 will be urged to cover the port 48 by the biasing member 60. In the closed position, annulus pressure is then allowed to equalize the pressure in the port 48 and the slip 34 can be easily pushed back in by bumping the casing.

Set forth below are some embodiments of the foregoing disclosure:

Embodiment 1: A single-trip cut and pull system for a wellbore including a cutter, a power section, and an anchor selectively actuable independently of the power section.

Embodiment 2: The single-trip cut and pull system for a wellbore as in any prior embodiment, wherein the cutter is rotatable to undertake a cutting operation by rotation of the string.

Embodiment 3: The single-trip cut and pull system for a wellbore as in any prior embodiment, wherein the anchor is settable and resettable.

Embodiment 4: The single-trip cut and pull system for a wellbore as in any prior embodiment, wherein the power section and anchor are hydraulically actuated components.

Embodiment 5: The single-trip cut and pull system for a wellbore as in any prior embodiment, wherein the anchor includes a switch to control actuation of the anchor.

Embodiment 6: The single-trip cut and pull system as in any prior embodiment, wherein the switch is a valve.

Embodiment 7: The single-trip cut and pull system for a wellbore as in any prior embodiment, wherein the valve is a tension valve.

Embodiment 8: The single-trip cut and pull system for a wellbore as in any prior embodiment, wherein the valve is an electrically actuated valve.

Embodiment 9: The single-trip cut and pull system for a wellbore as in any prior embodiment, wherein the valve is a mechanical left-hand J-slot valve.

Embodiment 10: The single-trip cut and pull system for a wellbore as in any prior embodiment, wherein the valve is a threshold pressure hydraulic valve.

Embodiment 11: A single-trip cut and pull system for a wellbore including a string, an anchor on the string, and a cutter on the string, the cutter rotatable to undertake a cutting operation by rotation of the string.

Embodiment 12: The single-trip cut and pull system for a wellbore as in any prior embodiment, wherein the anchor is selectively hydraulically actuated.

Embodiment 13: The single-trip cut and pull system for a wellbore as in any prior embodiment, wherein the anchor further includes a switch to control actuation of the anchor.

Embodiment 14: The single-trip cut and pull system as in any prior embodiment, wherein the switch is a valve.

Embodiment 15: The single-trip cut and pull system for a wellbore as in any prior embodiment, wherein the valve is a tension valve.

Embodiment 16: The single-trip cut and pull system for a wellbore as in any prior embodiment, wherein the valve is an electrically actuated valve.

Embodiment 17: The single-trip cut and pull system for a wellbore as in any prior embodiment, wherein the valve is a mechanical left-hand J-slot valve.

Embodiment 18: The single-trip cut and pull system for a wellbore as in any prior embodiment, wherein the valve is a threshold pressure hydraulic valve.

Embodiment 19: A method for cutting and pulling casing in a single run including running a cut and pull system on a string to a target depth, rotating a cutter of the cut and pull system to cut a casing section, and actuating an anchor of the cut and pull system after cutting the casing section.

Embodiment 20: The method as in any prior embodiment, wherein the rotating the cutter is by rotating the string.

Embodiment 21: The method as in any prior embodiment, wherein the actuating the anchor is by pressuring up on a fluid in the string.

Embodiment 22: The method as in any prior embodiment, wherein the method further comprises actuating a power section to pull the casing section.

Embodiment 23: A method for cutting and pulling casing in a single run including running a cut and pull system on a string to a target depth, rotating a cutter of the cut and pull system by rotating the string to cut a casing section, and pulling the cut casing in the single run.

Embodiment 24: The method as in any prior embodiment, wherein the pulling the casing section includes setting an anchor.

Embodiment 25: A borehole system including a borehole in a subsurface formation, a string in the borehole, a single-trip cut and pull system disposed as a part of the string, the a single-trip cut and pull system as in any prior embodiment.

Embodiment 26: A borehole system including a borehole in a subsurface formation, a string in the borehole, a single-trip cut and pull system disposed as a part of the string, the a single-trip cut and pull system as in any prior embodiment.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A single-trip cut and pull system for a wellbore comprising:

a cutter rotatable by a string attached to the system to cut a casing during use;

a mandrel connected to the string;

a power section;

a spear configured to set only after cutting of the casing; and an anchor selectively actuable independently of the power section and configured to set only after the cutting of the casing, wherein the anchor is settable and resettable based upon application of tensile load on the mandrel.

2. The single-trip cut and pull system for a wellbore as claimed in claim 1 wherein the power section and anchor are hydraulically actuated components.

3. The single-trip cut and pull system for a wellbore as claimed in claim 1 wherein the anchor includes a switch to control actuation of the anchor.

4. The single-trip cut and pull system as claimed in claim 3 wherein the switch is a valve.

5. The single-trip cut and pull system for a wellbore as claimed in claim 4 wherein the valve is a tension valve.

6. The single-trip cut and pull system for a wellbore as claimed in claim 4 wherein the valve is an electrically actuated valve.

7. The single-trip cut and pull system for a wellbore as claimed in claim 4 wherein the valve is a mechanical left-hand J-slot valve.

8. The single-trip cut and pull system for a wellbore as claimed in claim 4 wherein the valve is a threshold pressure hydraulic valve.

9. A single-trip cut and pull system for a wellbore comprising:

a string;

an anchor on the string actuable only after a cutting operation, the anchor being settable and resettable upon tension applied through the string;

a spear on the string actuable only after a cutting operation; and a cutter on the string, the cutter rotatable to undertake a cutting operation by rotation of the string.

10. The single-trip cut and pull system for a wellbore as claimed in claim 9 wherein the anchor is selectively hydraulically actuated.

11. The single-trip cut and pull system for a wellbore as claimed in claim 9 wherein the anchor further includes a switch to control actuation of the anchor.

12. The single-trip cut and pull system as claimed in claim 11 wherein the switch is a valve.

13. The single-trip cut and pull system for a wellbore as claimed in claim 12 wherein the valve is a tension valve.

14. The single-trip cut and pull system for a wellbore as claimed in claim 12 wherein the valve is an electrically actuated valve.

15. The single-trip cut and pull system for a wellbore as claimed in claim 12 wherein the valve is a mechanical left-hand J-slot valve.

16. The single-trip cut and pull system for a wellbore as claimed in claim 12 wherein the valve is a threshold pressure hydraulic valve.

17. A method for cutting and pulling casing in a single run comprising:

running a cut and pull system on a string to a target depth;

rotating a cutter of the cut and pull system by rotating the string to cut a casing section; and then in the single run:

actuating a spear of the cut and pull system after the cutting of the casing section; and actuating an anchor of the cut and pull system after cutting the casing section with a tensile load from the string.

18. The method as claimed in claim 17 wherein the actuating the spear is by left hand rotation of the string.

19. The method as claimed in claim 17 wherein the actuating the anchor is by pressuring up on a fluid in the string.

20. The method as claimed in claim 17 wherein the method further comprises actuating a power section to pull the casing section.

21. A borehole system comprising:

a borehole in a subsurface formation;

a string in the borehole;

a single-trip cut and pull system disposed as a part of the string, the single-trip cut and pull system as claimed in claim 1.

22. A borehole system comprising:

a borehole in a subsurface formation; and a single-trip cut and pull system disposed in the borehole, the single-trip cut and pull system as claimed in claim 9.

* * * * *